US006557981B1

(12) United States Patent
Fukano et al.

(10) Patent No.: US 6,557,981 B1
(45) Date of Patent: May 6, 2003

(54) INK JET RECORDER

(75) Inventors: Yoshinobu Fukano, Hitachi (JP); Seiji Yonekura, Hitachi (JP); Mamoru Okano, Hitachi (JP); Tatsuo Igawa, Kitaibaraki (JP); Kazuhito Masuda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/936,838

(22) PCT Filed: Jul. 12, 2000

(86) PCT No.: PCT/JP00/04667

§ 371 (c)(1),
(2), (4) Date: Sep. 18, 2001

(87) PCT Pub. No.: WO02/04216

PCT Pub. Date: Jan. 17, 2002

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 6,260,954 B1 * 7/2001 Lima-Marques

FOREIGN PATENT DOCUMENTS

JP 10-138491 * 5/1998
JP 10-296979 * 5/1998

OTHER PUBLICATIONS

International Publication No. WO 93/11866 (Jun. 1993).*
PCT National Publication No. 7–502218 (Sep. 1995).*

* cited by examiner

*Primary Examiner*—Raquel Yvette Gordon
(74) *Attorney, Agent, or Firm*—Antonelli, Terry, Stout & Kraus, LLP

(57) ABSTRACT

An ink jet recording head has a plurality of ink-discharge electrodes and control electrodes and an opposed electrode arranged at a fixed spacing and grounded. A pulse voltage with a reversed polarity is applied to the control electrodes in synchronization with the superimposition of the pulse voltage on a bias voltage applied to the ink-discharge electrode when the ink is discharged. As a result, an ink jet recording apparatus, which can decrease the pulse voltage needed to discharge the ink, is provided with a simple configuration.

18 Claims, 14 Drawing Sheets

INK JET RECORDER

BACKGROUND OF THE INVENTION

The present invention relates to an ink jet recording apparatus which operates to print an image by applying ink drops discharged from an electrode of a recording head to a recording medium.

An apparatus which discharges liquid ink as small droplets and deposits them on a recording medium so as to record an image by forming dots in a designated pattern has been put to practical use as an ink jet printer. This ink jet printer has the capability of make little noise compared with other recording methods and to record an image directly on a recording medium. Therefore, there is an advantage that this printer can be constructed of a smaller number of parts than that of other recording methods.

A method which has recently received attention, in which the ink is discharged by using the electrostatic force, is disclosed in the PCT National Publication No. 7-502218 (1995). More specifically, a method of producing an ink discharge after the concentration of the coloring material particles is improved by using ink which contains electrified coloring material particles is disclosed in this official report.

In the recording head used in this method, a plurality of ink-discharge electrodes are arranged on one insulated substrate at regular intervals, and an individual pulse drive circuit is connected to each ink-discharge electrode. The pulse drive circuit is controlled so as to superimpose a pulse voltage Vp or the voltage applied to the ink-discharge electrode independently according to the print data supplied from a personal computer etc. The advantage of this method is that the amount of ink being discharged can be controlled by changing the width of the pulse voltage, and the gradation of the color image can be expressed by controlling the area of the record dot formed on a recording medium. Japanese Patent Application Laid-Open No. 10-296979 discloses an example of such a recording head, in which the discharge electrode and the electric field concentration auxiliary electrode are alternately arranged on the recording head.

In the method disclosed in the PCT National Publication No. 7-502218 and the Japanese Patent Application Laid-Open No. 10-296979, a voltage of about 1.5–2.0 kV is applied to all the ink-discharge electrodes as an electrode bias, and a pulse voltage of about 600V is superimposed on this bias voltage applied to the ink-discharge electrode when ink is discharged. Further, because ink is discharged from a plurality of ink-discharge electrodes at the same time, it is essential to provide a driving circuit for switching and controlling the pulse-like high voltage applied to these ink-discharge electrodes. However, an element, such as a field-effect transistor (FET) of the high voltage type is necessary for switching a pulse voltage of about 600V, as mentioned above.

As for the driving circuit which uses such an element, the scale increases.

Although a general-purpose high voltage IC may be used in place of a FET to reduce the circuit scale and achieve a low-priced device, the switching voltage limit is 300V or less in such a high voltage IC. Therefore, it is necessary to discharge ink at the pulse voltage of 300V or less if the driving circuit is provided with a general-purpose high voltage IC in the ink jet recording apparatus of this method. In a technique disclosed in Japanese Patent Application Laid-Open No. 10-138491, a gate electrode having a plurality of gate halls arranged monotonously in a row is provided in front of the record electrode as a means for solving such a problem.

SUMMARY OF THE INVENTION

Because a pulse with a reversed polarity is applied to a corresponding gate electrode according to the method of the above-mentioned Japanese Patent Application Laid-Open No. 10-138491 when a voltage is applied to the record electrode, it is possible to reduce the drive voltage to one-half. However, when the record electrode and the gate hall on the gate electrode are arranged with the same spacing, a position adjustment of high accuracy is needed. Therefore, the production cost of the recording head increases, because the manufacturing technology having a high processing accuracy is needed.

Further, there is a problem in that the ink tends to produce a bridge (liquid junction) between the point of the record electrode and the gate electrode, so that ink discharge becomes impossible, due to the fact that the state of flight of the ink droplets becomes unstable because of turbulence when the ink is discharged from the point of the record electrode.

In consideration of the above-mentioned problems, the present invention adopts the following configuration. An ink jet recording apparatus comprises a plurality of ink-discharge electrodes; a control electrode arranged between adjoining ink-discharge electrodes; an opposed electrode arranged at an opposed position with a fixed spacing from the points of said plurality of the ink-discharge electrodes; a power supply connected to said plurality of ink-discharge electrodes and said control electrodes; a first pulse drive circuit connected to said plurality of ink-discharge electrodes; and a second pulse drive circuit connected to said control electrodes; wherein said the second pulse drive circuit outputs a pulse voltage with a reversed polarity to that of said first pulse drive circuit.

Further, the present invention adopts the following configuration. An ink jet recording apparatus comprises a plurality of ink-discharge electrodes; a control electrode arranged between adjoining ink-discharge electrodes; an opposed electrode arranged at an opposed position with a fixed spacing from the points of said plurality of ink-discharge electrodes; a migration electrode arranged on the opposite side of said opposed electrode with respect to said ink-discharge electrodes and said control electrodes; a first power supply connected to said plurality of ink-discharge electrodes and control electrodes; a second power supply connected to said migration electrode; a first pulse drive circuit connected to said plurality of ink-discharge electrodes; and a second pulse drive circuit connected to said control electrodes; wherein said second pulse drive circuit outputs a pulse voltage with a reversed polarity to that of said first pulse drive circuit.

By adopting the above-mentioned configuration, the present invention can provide an ink jet recording apparatus in which the voltage drive method for decreasing the ink-discharge pulse voltage to a voltage level at which the switching can be performed using a general-purpose high voltage IC.

BEST MODE FOR CARRYING OUT THE INVENTION

Embodiments of the present invention will be explained with reference to the drawings.

Figure 5A:
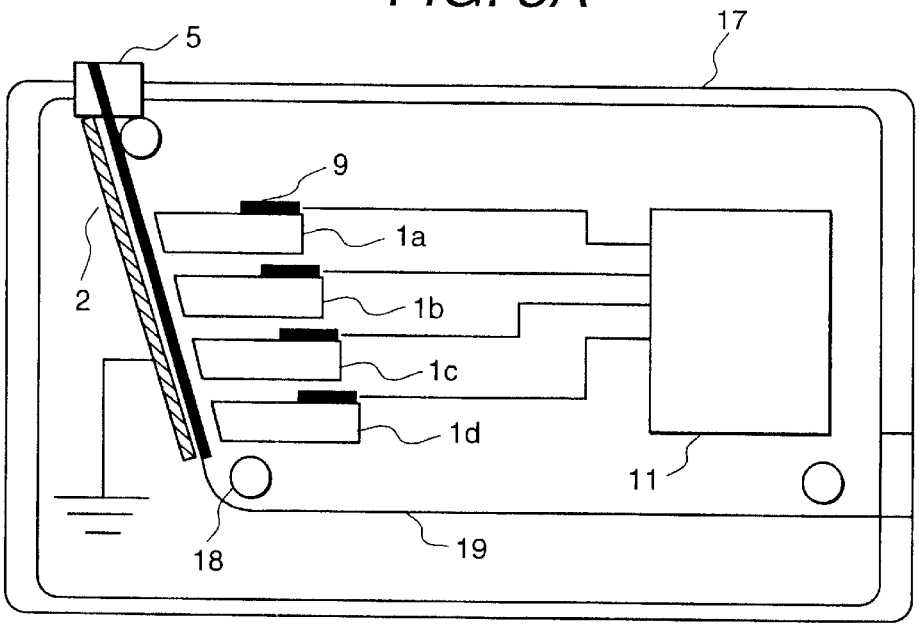
FIGS. 5A and 5B are diagrams showing one example of the overall configuration of the ink jet recording apparatus according to the present invention.
Figure 5B:
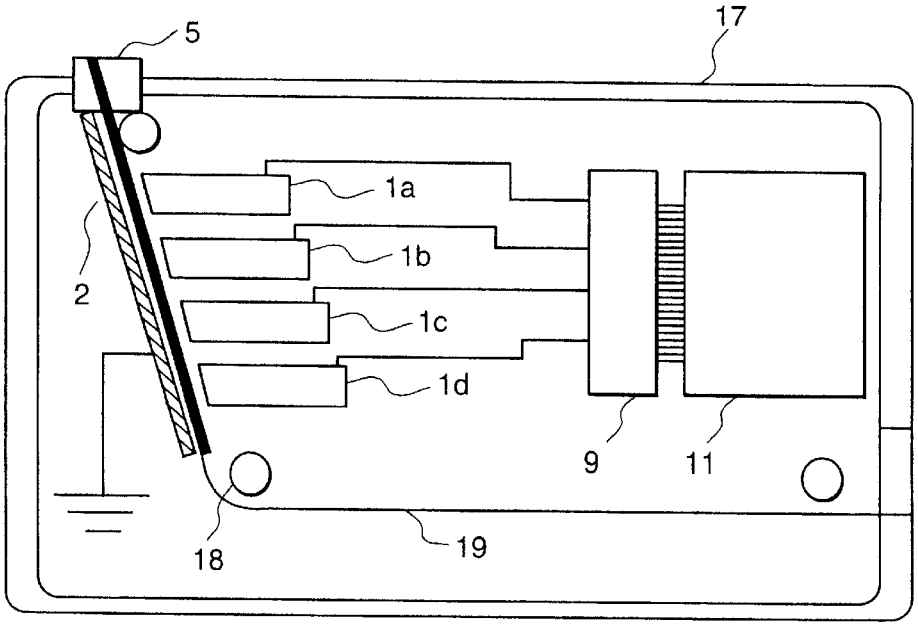

FIGS. 5A and 5B show an example of the configuration of the ink jet recording apparatus provided with ink jet recording heads 1(1*a*,1*b*,1*c*,1*d*), an ink circulation part, and the controller 11 according to the present invention. Ink jet recording heads 1, the ink circulation part and the controller 11 are mounted in housing 17. Ink jet recording head 1 has a configuration in which an electrode and an ink channel are provided on an insulated substrate, as will be described later.

In a multi-color print, such as a color image, for example, ink of yellow (Y), magenta (M), cyan (C), and black (K) is supplied to the ink jet recording heads 1*a*–1*d*, respectively. Recording medium 5 is transported along transportation path 19 by a transportation roller 18, which forms part of a transportation mechanism, and a respective color image is printed by each of the ink jet recording heads 1*a*–1*d*. An electrode bias is applied to the recording heads 1*a*–1*d*. The print data relating to each color is sent from controller 11 to a pulse drive circuit 9 with an exact print timing, and a pulse voltage to allow each of the recording heads 1*a*–1*d* to discharge ink is superimposed on the electrode bias.

A separate pulse drive circuit 9 can be provided on each recording head as shown in FIG. 5A, and it also can be provided as a single unit in housing 17, separately from the heads, as shown in FIG. 5B. The configuration of FIG. 5A is suitable for effecting miniaturization of the heads and the circuit if a high voltage driver IC is employed, as will be described later, because they can be manufactured on one substrate at the same time by using a thin film process. On the other hand, the configuration of FIG. 5B can simplify the wiring used to transmit the image data and control signals, etc. from controller 11, because the high voltage circuit for the recording head for four colors can be consolidated in one circuit board.

Figure 1:
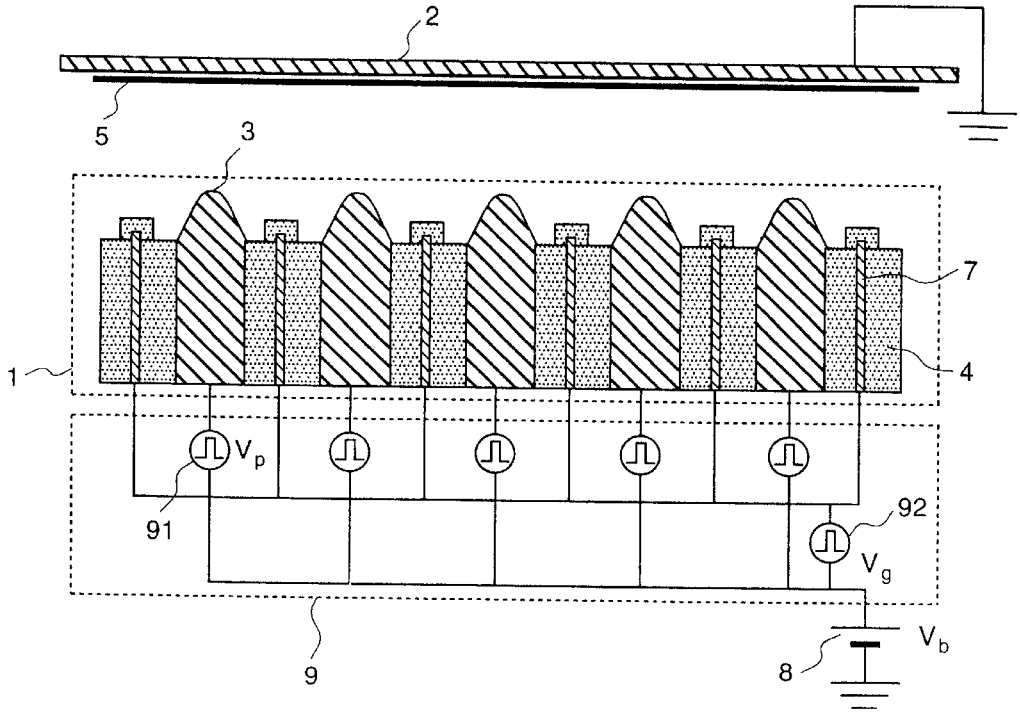
FIG. 1 is a sectional view of an embodiment of an ink jet recording apparatus according to the present invention.

FIG. 1 is a schematic diagram showing the basic components of the ink jet recording apparatus according to a first embodiment.

Recording head 1 has a configuration in which a plurality of ink-discharge electrodes 3 and control electrodes 7 are alternately arranged in parallel, for instance, at intervals of 250 $\mu$m in the main scanning direction of the print medium, as shown in FIG. 1. Because a potential difference is generated between ink-discharge electrode 3 and the adjoining control electrode 7 at the time of ink discharge, as will be described later, it is necessary to set the interval to the above-mentioned wiring pitch so as not to exceed the insulation between electrodes. Opposed electrode 2 is provided at a position which is at a fixed distance from the point of ink-discharge electrode 3, and recording medium 5 is disposed on the opposed electrode 2 to enable images and characters to be printed thereon.

Further, an individual pulse drive circuit 91 is connected to each ink-discharge electrode 3, and a common pulse drive circuit 92 is connected to the control electrodes 7. Here, pulse drive circuit 91 and 92 from the pulse drive circuit 9 shown in FIG. 5. In addition, common bias supply 8 is connected to all electrodes.

Ink-discharge electrode 3 and control electrode 7 are formed on an insulated substrate, such as one sheet of glass.

By coating the substrate with high a substance of dielectric constant like the glass (About $\in$s=7–10), for example, with a thin film having a low dielectric constant, like the polyimide system (About $\in$=3.4), a decrease in the degree of concentration of the electric field caused at the point of ink-discharge electrode 3 can be prevented when ink is discharged. In other words, it is preferable to use an insulated organic material of the polyimide system etc. with low dielectric constant as the material of this substrate. Further, this thin film works as base for the part projecting from the end face of the insulated substrate of the ink-discharge electrode 3 and control electrode 7. The part projecting from the end face of the insulated substrate can be formed by using a photosensitive material for the thin film and photolithography. With regard to the size of the recording head 1, an accuracy of a $\mu$m or less of soils can be achieved at a low-cost by using such a manufacturing method. In addition, to form ink-discharge electrode 3 and control electrode 7 on the substrate as a film electrode of about 1–2 $\mu$m, the metal is deposited on the substrate by the method of vacuum evaporation etc.

Here, to prevent the surface of the electrode from touching the ink directly, the thin film protection layer (not shown) may be coated. This is done for the following reason.

Because the insulated organic material used for the protection film has a lower surface energy compared with the metal, the coloring material particles contained in the ink 6 become hard to fix. Further, the ink-discharge electrode 3 is covered with a shroud member 4 made of insulated material excluding the upper surface (front side in figure) portion of the ink-discharge electrode 3. Therefore, control electrode 7 is embedded within shroud member 4. In addition, the upper surface of the shroud member 4 is blocked with a sheet-like ceiling material. The part not occupied by shroud member 4 becomes an ink channel of the ink-discharge electrode 3. Ink 6 flows through the ink channel down to the back of the insulated substrate while maintaining a stable form of liquid surface at the point of the ink-discharge electrode 3. As described above, the point of ink-discharge electrode 3 projects, for example, by about 100–200 $\mu$m from the end face of the insulated substrate so as to strengthen the electric field at the point. Further, control electrode 7 projects, for instance, by about 20–40 $\mu$m from the end face of the insulated substrate. The purpose of this configuration is to improve the control effect of the electric mutual interference between the adjoining ink discharge electrodes. In other words, the control effect of the best mutual interference can be achieved from the end face of the insulated substrate by projecting control electrode 7, with respect to ink-discharge electrode 3, as much as about 20 percent of its length. If the projection length of control electrode 7 is beyond the above-mentioned range, the electric field at the point of the ink-discharge electrode 3 is weakened oppositely. If it is in lower in height than the above-mentioned range, the control effect of mutual interference becomes insufficient. Further, the projecting part of control electrode 7 is also covered with shroud member 4. Here, shroud member 4 for the projecting part of control electrode 7 serves to physically separate the ink stream between the adjoining ink discharge electrodes 3. As a result, the possibility that the ink surface form (ink meniscus) will be connected between the adjoining ink discharge electrodes 3 and the bridge (liquid junction) is prevented. Further, the possibility that the ink meniscus exerts a bad influence between respective ink-discharge electrodes 3 at the time of ink discharge is also prevented.

Figure 4:
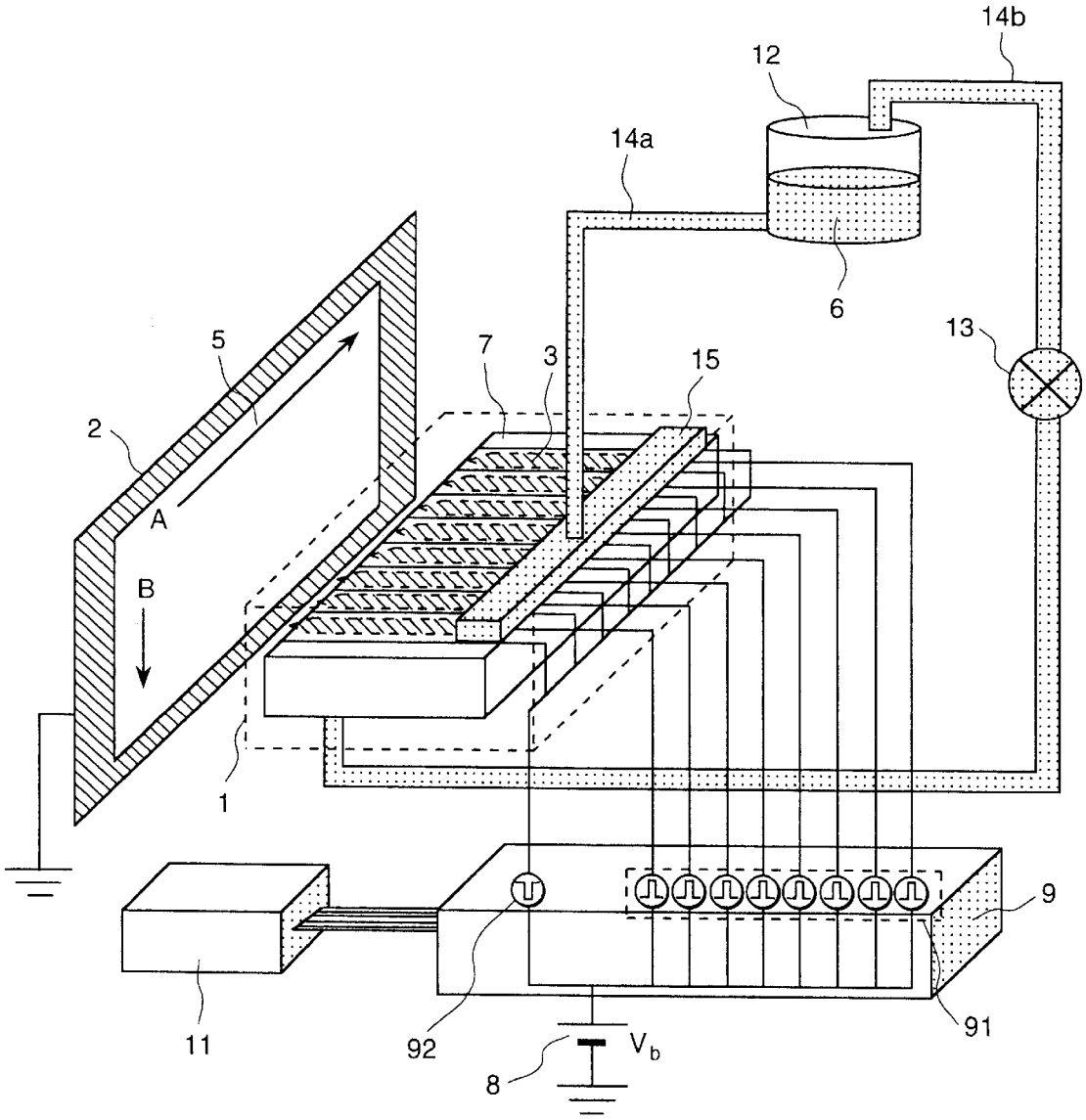
FIG. 4 is a schematic diagram showing the detailed configuration of one embodiment of the ink jet recording apparatus according to the present invention.

FIG. 4 shows the configuration of the ink jet recording head 1, an ink circulation part and a control circuit part in the first embodiment. The ink 6 which is used in the printer according to the present invention has components in which electrified coloring material particles are distributed in an organic solvent. More specifically, the coloring material particles have a configuration such that an electrification control agent and a dispersing agent, etc. are given to the pigment particles, and an individual coloring material particle is contained in the organic solvent while electrified. Ink 6 flows from ink tank 12 to ink circulation circuit 14*a* by using the head difference and is supplied to recording head 1. Recording head 1 is composed of an insulated substrate, ink-discharge electrodes 3, control electrodes 7, and ink channels.

Ink 6 is supplied to the ink channel in recording head 1 through ink introduction passage 15 provided between ink circulation circuit 14*a* and recording head 1. Ink 6 is supplied to the point of ink-discharge electrode 3 through ink channels provided on the upper surface of each ink-discharge electrode 3. A plurality of ink-discharge electrodes 3 and control electrodes 7 are arranged alternately in the recording head 1 relative to the main scanning direction of the print medium (direction of arrow A in figure) at a constant array pitch.

Pulse drive circuit 9 is composed of pulse drive circuits 91 and 92, which are connected to ink-discharge electrode 3 and control electrode 7, respectively, and pulse drive circuit 9 is controlled by controller 11. Further, a constant electrode bias is supplied to recording head 1 by bias supply 8.

Here, as will be described later, the electrode bias can be controlled while printing, by controlling the bias supply 8 using controller 11. The application of the voltage to ink-discharge electrode 3 is controlled by control signals being independently transmitted from controller 11 to each pulse drive circuit 91 according to the print data sent by the personal computer etc. The ink 6 is discharged, by the electric field in the neighborhood of the point of the ink-discharge electrode 3, from ink-discharge electrode 3, to which a voltage is applied by pulse drive circuit 91, toward opposed grounded electrode 2. As a result, a dot is formed on the recording medium 5 disposed adjacent opposed electrode 2, so that images and characters are printed thereon. When the printing of one line in the main scanning direction is completed, the recording medium 5 is moved in the sub-scanning direction (direction of arrow B in figure) only by one dot pitch of the print resolution by the transportation mechanism, including the transportation roller 18, along the transportation path 19 shown in FIG. 5. Then, the printing for the following line is begun. The printing for one page is accomplished by repeating such print work in the printing area on recording medium 5. Ink 6 which has remained without being consumed during the ink discharge process of the print work flows from the point of the ink-discharge electrode 3 to the back of the recording head 1 along with the ink circulation stream. Ink 6 which flows to the back of the recording head 1 is sucked by pump 13 from the ink deriving passage 15 (not shown) and is fed into the ink circulation passage 14*b*. Ink 6 which flows in the ink circulation passage 14*b* is returned to the ink tank 12 and is used for printing again.

The feature of this embodiment is that the voltage with a reversed polarity is applied to the control electrodes 7 so that the voltage at the control electrodes 7 may become lower than the electrode bias, in synchronization with the application of the voltage from pulse drive circuits 91 to ink-discharge electrodes 3. Hereinafter, the technique for realizing such voltage-application control will be explained in detail.

Figure 2A:
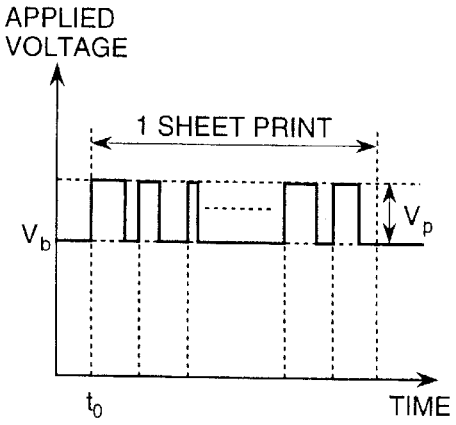
FIGS. 2(*a*) and 2(*b*) are waveform diagrams showing one example of the waveforms of the voltages applied to the ink-discharge electrode and the control electrode of the present invention, respectively.
Figure 2B:
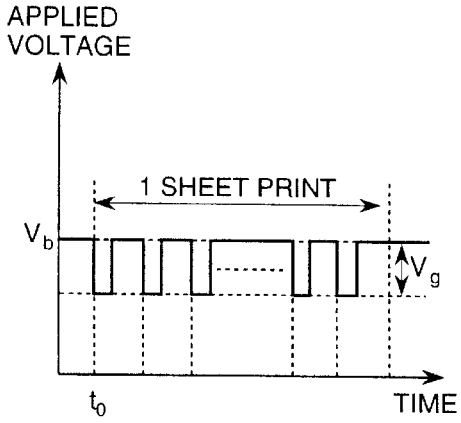

FIG. 2(*a*) shows the voltage waveform applied to the ink-discharge electrode 3 in the recording head 1. The voltage, which is pulse-width modulated according to the data to be printed, is individually applied to each of the ink-discharge electrodes 3 during one page of printing. On the other hand, FIG. 2(*b*) shows the voltage waveform applied to control electrode 7. This voltage is supplied to all control electrodes 7. Here, the electrode bias Vb is applied to all electrodes in recording head 1 from common bias supply 8 as shown in FIG. 1. For instance, when one page of printing starts at a certain timing to, pulse voltage Vp, corresponding to each item of print data, produced by pulse drive circuit 91 is superimposed on the electrode bias Vb in the ink-discharge electrode 3. Here, in order to express the gradation of one pixel by changing the area of one dot, pulse voltage Vp is subjected to pulse width modulation and is applied to the ink-discharge electrode 3 in the printing interval. On the other hand, the voltage to lower the voltage of the control electrode from voltage Vb to the voltage Vb−Vg during the printing interval is applied from pulse drive circuit 92 to control electrode 7 in synchronization with the superimposition of pulse voltage Vp when each pixel is printed. The reason why pulse voltage Vp, which is superimposed on the bias applied to ink-discharge electrode 3, can be a low voltage in accordance with the above-mentioned method of applying the voltage will be explained based on the result of the effects of a two-dimensional electric field.

Figure 3A:
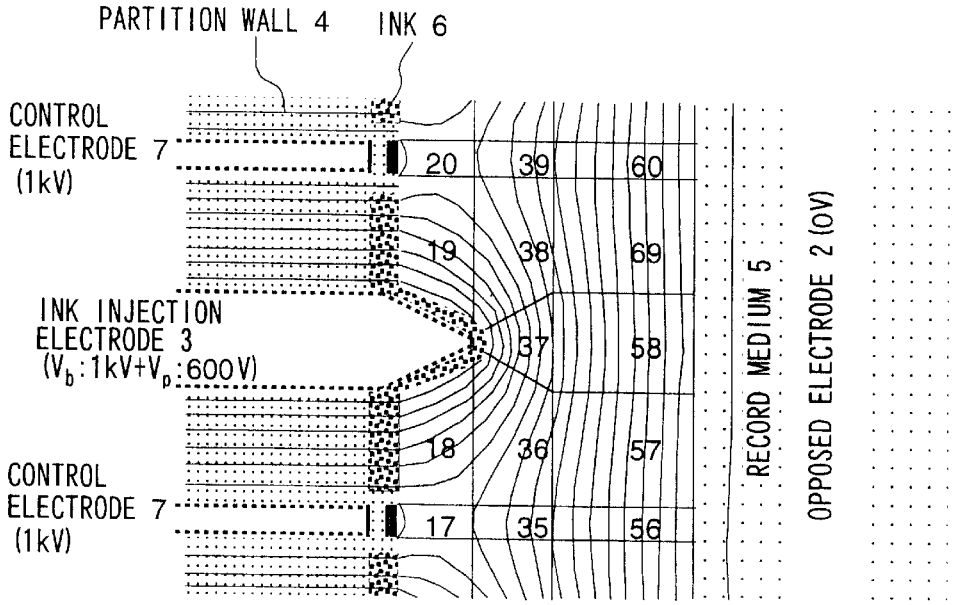
FIGS. 3A and 3B are equipotential line diagrams showing the calculation result of the two-dimensional electric field in the point of a recording head of the ink jet recording apparatus according to the present invention.
Figure 3B:
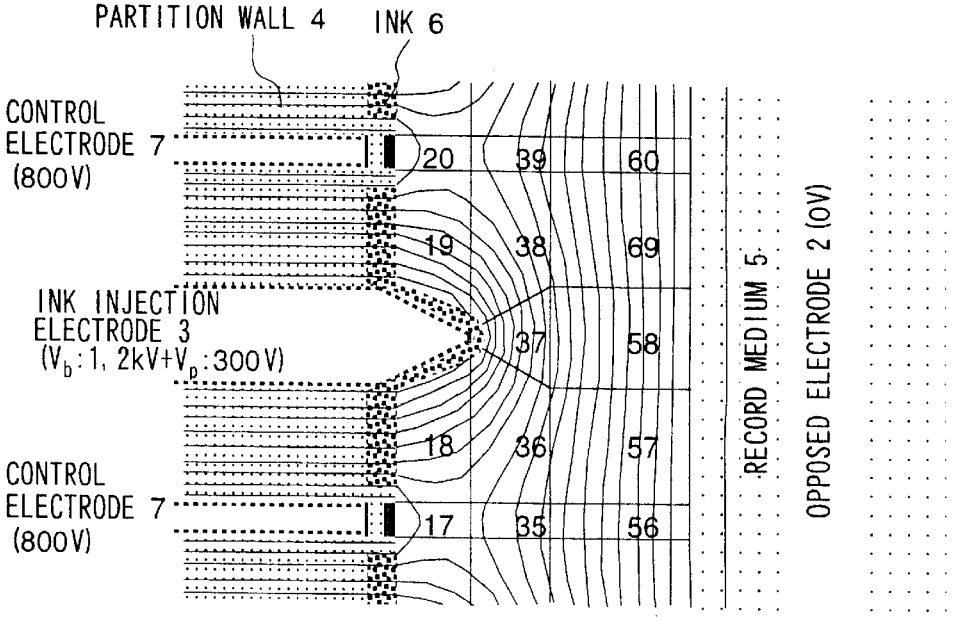

FIGS. 3A and 3B are equipotential line diagrams showing the result obtained by calculating the two-dimensional electric potential distribution in the configuration of this embodiment by the difference method. FIG. 3A shows the electric potential distribution in the conventional voltage applying method. FIG. 3B shows an electric potential distribution in the method according to this embodiment.

The size and form of the electrodes etc. were the same, and the only change was how to apply the voltage calculated under the following conditions.

Ink-discharge electrode
- Width: 140 μm
- Projection length from the end face of the substrate: 140 μm
- Radius of curvature of the point: 10 μm Control electrode
- Width: 50 μm
- Projection length from the end face of the substrate: 20 μm
- Thickness of the shroud member covering the point: 20 μm.

Spacing between the ink-discharge electrode and the control electrode: 250 μm

Spacing between ink-discharge electrode and the surface of the recording medium: 300 μm Thickness of the recording medium: 100 μm Dielectric constant of the recording medium: 2.6

Dielectric constant of the shroud member: 3.3

Dielectric constant of the ink: 2.6

Potential of the opposed electrode: 0V

In the conventional voltage applying method shown in FIG. 3A, the voltage of 1 kV is applied to both the ink-discharge electrode 3 and control electrode 7 as an electrode bias. In addition, the voltage of 600V is superimposed on the bias applied to the ink-discharge electrode 3 as a pulse voltage to discharge the ink. At this time, the electric field at the point of the ink-discharge electrode 3 is about 4 MV/m by calculation. Therefore, an electric field necessary to cause the ink to discharge from the point of the ink-discharge electrode 3 becomes about 4 MV/m. On the other hand, the voltage of 1.2 kV is applied to the ink-discharge electrode 3 as an electrode bias at the time of ink discharge, and the voltage of 300V is superimposed on the bias voltage of the electrode as a pulse voltage in the method of this embodiment, as shown in FIG. 3B. In addition, to lower the voltage at control electrode 7 by 400V below the electrode bias, 800V is synchronously applied. The electric field at the point of the ink-discharge electrode 3 is about 4 MV/m by calculation.

Further, by comparing the distribution of the equipotential line of FIGS. 3A and 3B, it is understood that both the distribution of the equipotential lines in the neighborhood of the point of the ink-discharge electrode and the spacings are very similar. Therefore, it becomes possible to decrease the pulse voltage from 600 to 300V because the same electric field as that generated by the conventional method can be formed even by the pulse voltage of 300V. Because the electric potential distribution between the ink-discharge electrode 3 and the opposed electrode 2 becomes unequal in that the electric potential concentrates in the neighborhood of the ink-discharge electrode 3, the electric field at the point of the ink-discharge electrode is strongly affected by the electric potential distribution in the neighborhood. Therefore, the electric field at the point of the ink-discharge electrode can be easily strengthened by controlling the electric potential in the neighborhood of the point of the ink-discharge electrode by control electrode 7.

Figure 6:
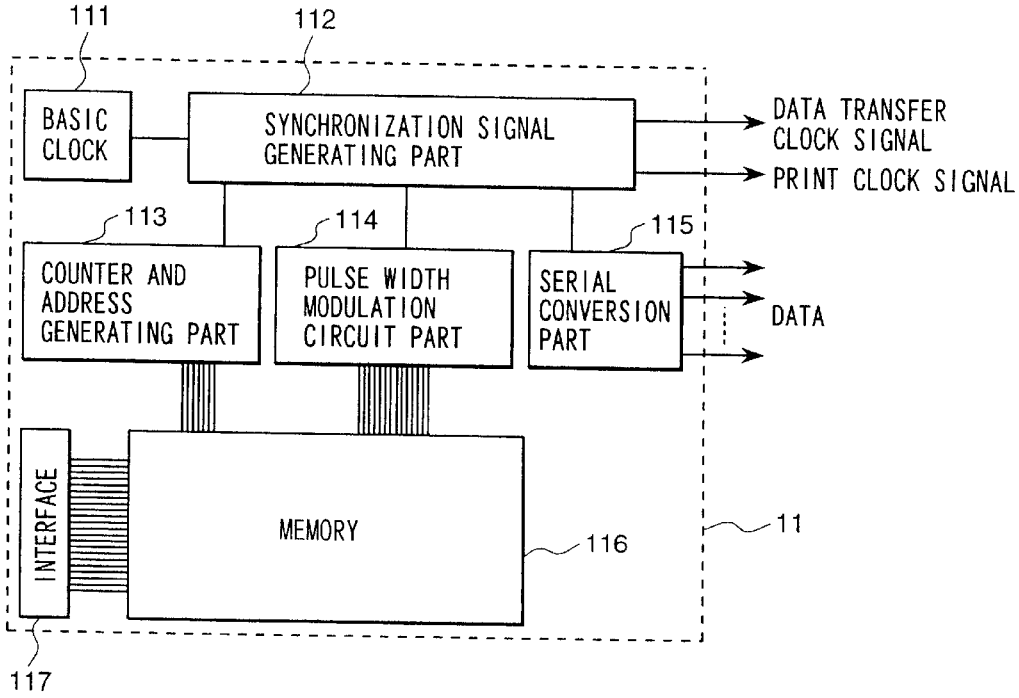
FIG. 6 is a block diagram of one embodiment of the controller of the ink jet recording apparatus according to the present invention.

Next, the circuit structure to achieve the applied voltage control used in this embodiment will be explained with reference to a concrete example. FIG. 6 is an example showing basic components in the controller 11 of FIG. 5. Basic clock circuit 111 generates a reference signal for all synchronizing signals which affect the print operation. Synchronizing signal generation unit 112 generates synchronizing signals necessary for each process of the print operation by dividing the reference signal sent from basic clock circuit 111. The image data sent by the personal computer etc. is stored in memory 116 through interface 117. When all the image data is stored, and the command indicative of the start of the print is originated, a signal is sent to the actuator of the motor for transporting the recording medium 5 (not shown) from the synchronizing signal generation unit 112. As a result, the recording medium 5 is transported to a position between recording head 1 and opposed electrode 2, as shown in FIG. 5.

When information, indicating that recording medium 5 has reached the position where printing is to be started, is transmitted to controller 11 by the position detection sensor (not shown) etc., the image data stored in memory 116 is read out one pixel at a time in the order of the printing by counter and address generation unit 113 and is sent to pulse width modulation circuit 114. Here, it is possible to use a configuration in which the image data for one line is read and temporarily stored in the buffer memory, such as a line memory. In this configuration, the image data for the following one line is read from the memory 116 while the image data of each pixel in one line is being converted into pulse duration modulation data in pulse width modulation circuit 114 and stored in the buffer memory temporarily. When all of the processing of the image data for the previous one line is completed, the procedure is repeated. The data in the line memory is loaded into the pulse width modulation circuit and the following image data of one line is stored in the line memory.

The signal processed in pulse width modulation circuit 114 is sorted so that a pulse voltage is output from the power output channel of the high voltage IC corresponding to the ink-discharge electrode 3 in serial converter 115 at the position of each pixel, and it is transmitted to the input of the high voltage IC as serial data. The entire operation to here is controlled by synchronizing signal generation unit 112. In addition, synchronizing signal generation unit 112 transmits the data transfer clock pulse so as to write data in the high voltage IC when the image data is transmitted and the print clock pulse which becomes a synchronizing signal to cause the pulse voltage to be superimposed at all of the ink-discharge electrodes while printing one line. Pulse drive circuit 92 for controlling the voltage applied to control electrode 7 controls the voltage at control electrode 7 so as to lower the voltage by using this print clock pulse in synchronization with the pulse voltage applied to the ink-discharge electrode.

Figure 7:
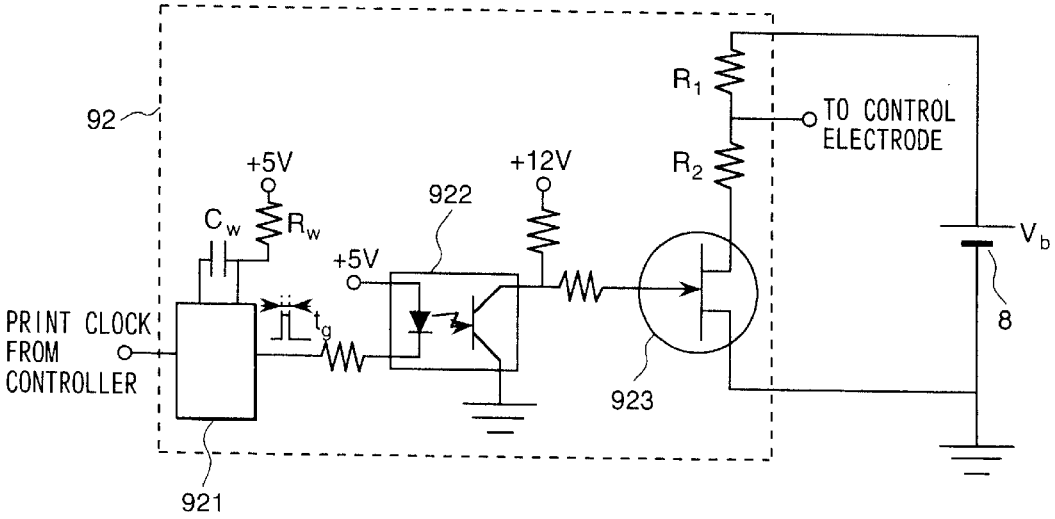
FIG. 7 is a schematic circuit diagram showing one example of the pulse drive circuit for the control electrode of the present invention.

FIG. 7 shows one example of the configuration of the pulse drive circuit 92. The print clock pulse sent from controller 11 is input to pulse generation circuit 921 to switch the voltage of control electrode 7 as a trigger signal. Pulse generation circuit 921 has an element which generates a single pulse signal with a constant pulse width tg when the trigger input, for example, from a monostable multivibrator, is received. Here, the pulse width tg of the output pulse signal is determined by the following equation on the basis of a capacitor Cw and resistor Rw provided in the pulse generation circuit 921.

$$tg=Cw\cdot Rw \quad (1)$$

The output signal of the pulse generation circuit 921 is transmitted to the input of switching element 923 through a photocoupler 922. Photocoupler 922 acts to electrically insulate the switching element 923, to which the voltage of about 1 kV is applied, from the pulse generation circuit, which operates at a TTL level (5V). Here, a high voltage field-effect transistor (FET) can be used for the switching element 923. Bias supply 8 is connected through series resistors R1 and R2 to the source(S)-drain(D) of switching element 923. The output terminal provided between resistors R1 and R2 is connected to control electrode 7. Here, when the voltage of the output terminal is assumed to be Vout, switching element 923 is in an OFF-state when the ink is not discharged, and Vout=Vb. When the ink is discharged or when the pulse voltage is superimposed on the ink-discharge electrode 3, a print clock signal is provided from controller 11. And, switching element 923 is switched to the ON-state only during time tg in response to the pulse signal generated in pulse generation circuit 921, and the voltage given by Vout=(R2/(R1+R2))Vb is output to the output terminal. As a result, the voltage control shown in FIG. 2(*b*) can be achieved. Because the pulse-lowered voltage Vg at this time is given by Vg=(R1/(R1+R2)) Vb, voltage Vg can be freely set by selecting the value of resistors R1 and R2.

Figure 8:
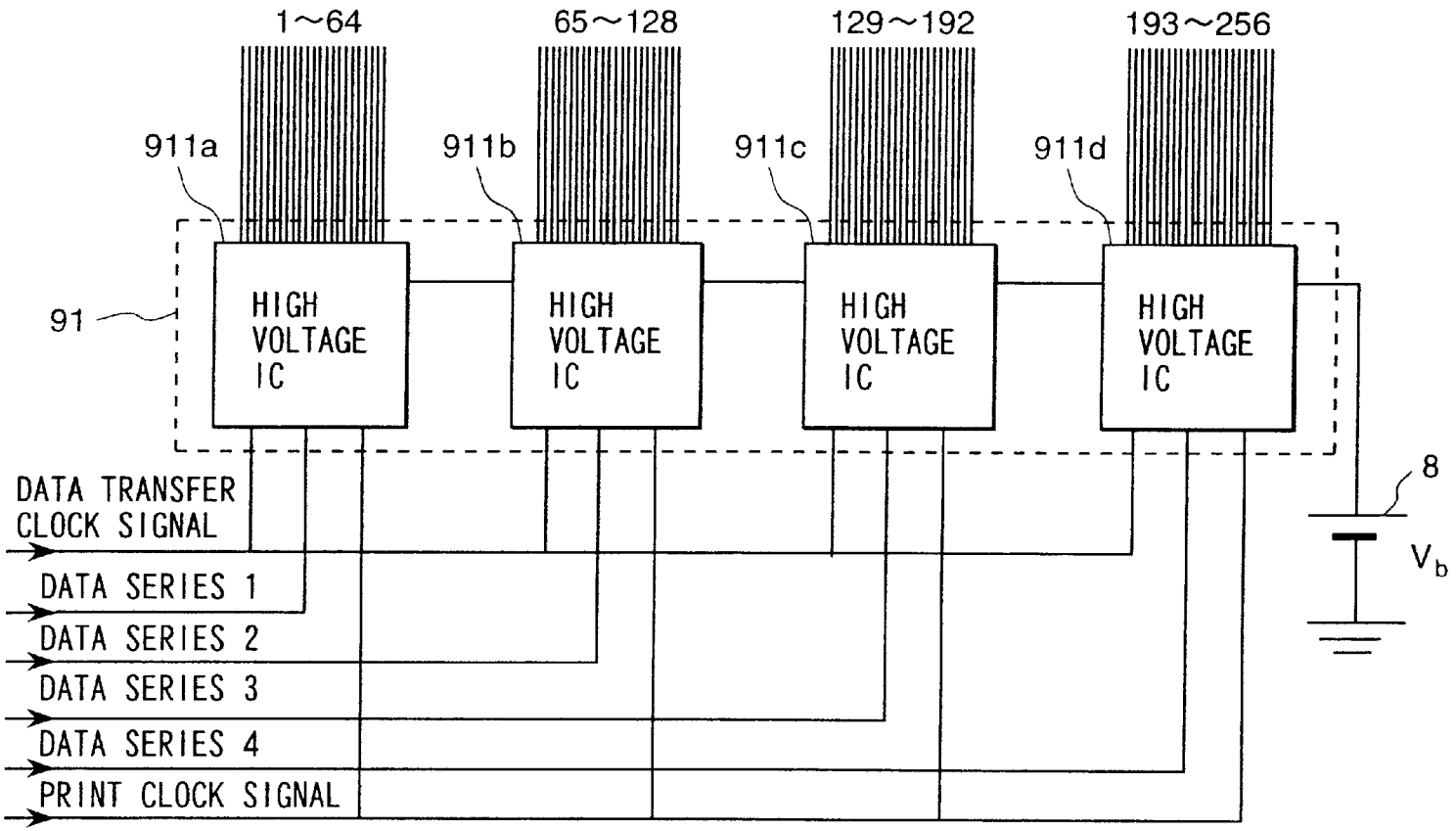
FIG. 8 is a block diagram showing the driving circuit for the ink-discharge electrode of the present invention, in which a high voltage IC is used.
Figure 9:
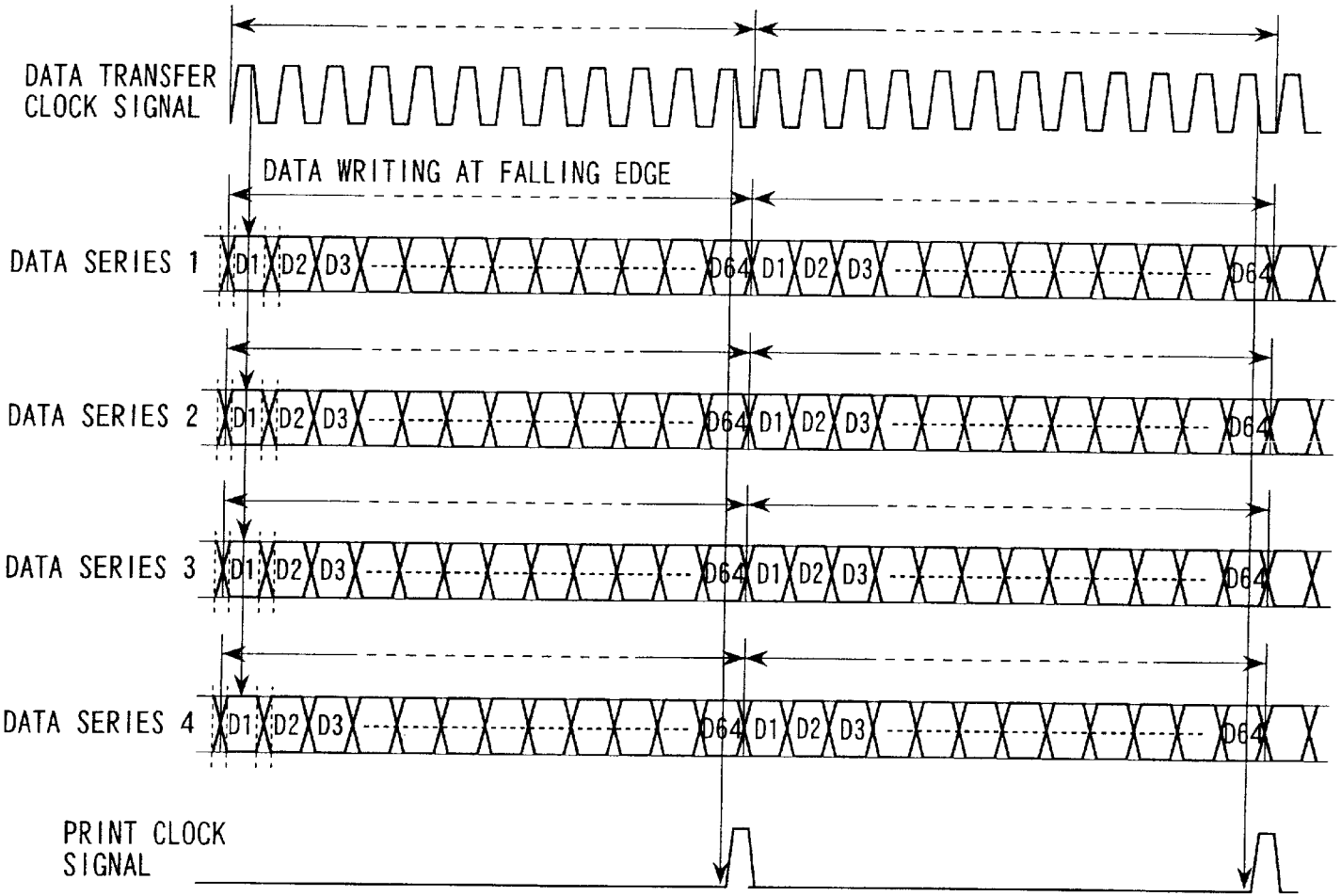
FIG. 9 is a timing diagram illustrating the writing of print data to a high voltage IC and the timing of the high voltage side power output in FIG. 8.

A basic method of driving a plurality of ink-discharge electrodes 3 in parallel using a high voltage IC will be explained. FIG. 8 shows one example of a configuration including pulse drive circuit 91 in the recording head 1, which uses general-purpose high voltage ICs 911*a*–911*d*. Here, an example of a driving circuit in which a power output of 256 channels is provided by using high voltage ICs with 64 channel power outputs will be explained. The print clock pulse and the data transfer clock pulse sent from controller 11 are input to the four high voltage ICs 911*a*–911*d*. Further, the image data of each high voltage IC distributed by a serial converter 115 in controller 11 is individually input to high voltage ICs 911*a*–911*d* as data series 1–4. The timings of this data transfer clock pulse, data series 1–4, and print clock pulse are shown in FIG. 9. The data for 64 channels are written in the shift register in a high voltage IC when the image data for one line is printed, because the image data is serially transmitted from controller 11. Here, the logic written at the rising edge is acceptable, although the writing operation is performed at the falling edge of the data transfer clock pulse. The print clock pulse is provided to high voltage Ics 911*a*–911*d* when the writing of the 64 data is completed, and 64×4=256 data is output from each channel in parallel.

According to this embodiment, it is possible to allow the pulse voltage to cause the discharged ink to be less than 300V by a simple configuration in which the grid electrode etc. are not used. As a result, because a general-purpose high voltage IC can be used for the driving circuit in the recording head, the circuit scale can be reduced compared with the pulse drive circuit in which an element like a field-effect transistor is used. That is, it is possible to lower the price because the driving circuit can be minutualized and the circuit can be composed of cheap ICs. Therefore, the recorder itself can also be reduced in scale and price.

Figure 10:
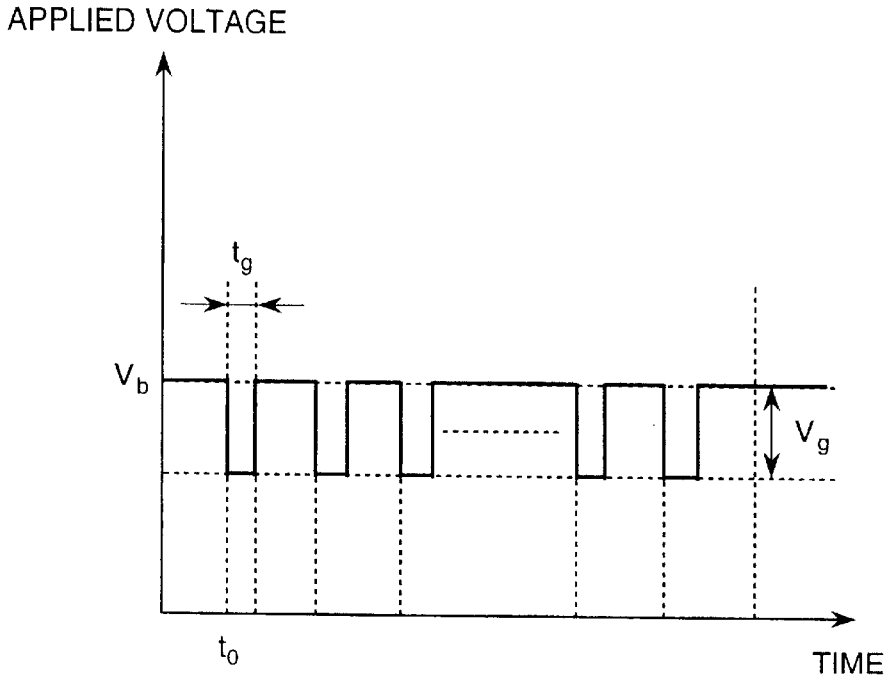
FIG. 10 is a diagram showing one example of the waveform of the voltage applied to the control electrode of the ink jet recording apparatus according to the present invention.
Figure 11:
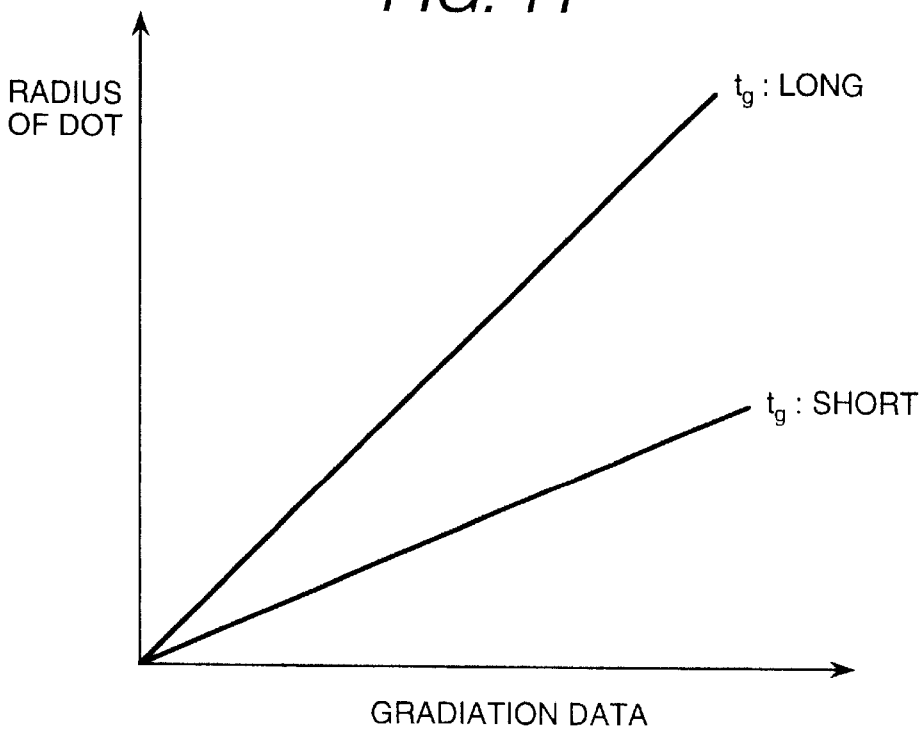
FIG. 11 is a graph showing the relationship between the gradation data and the print dot diameter of the ink jet recording apparatus according to the present invention.

Next, a second embodiment of the present invention will be explained. The feature of this embodiment is that the resolution can be converted by changing the time tg so as to lower the voltage applied to control electrode 7 from electrode bias Vb to Vb−Vg. Because the recording head 1 according to this embodiment has the same configuration as that shown in FIG. 4, an explanation thereof is omitted here. FIG. 10 shows the voltage waveform applied to control electrode 7. When the pulse voltage is superimposed on the ink-discharge electrode 3 and ink 6 is discharged, the voltage of control electrode 7 is controlled from electrode bias Vb to the voltage Vb−Vg only during time tg in synchronization with the discharge of ink. In the case where the period during which the voltage of control electrode 7 is at a low level is changed by changing the value of tg, the size of the dot diameter actually printed on recording medium 5, with respect to the gradation level of the print data becomes that shown in FIG. 11. The following matter is confirmed by the print experiment. While the inclination of the change is low when time tg is short and the range of the change of the dot diameter is small, the inclination of the change is large when time tg is long, and the range of the change in the dot diameter is large. These results shows that printing in the range of a smaller dot diameter, or about 10 mm to 60 mm, like printing at 600 dpi, and printing in a range of larger dot diameter, or 30 mm to 120 mm, like printing at 300 dpi, can be realized merely by changing the time width tg when the voltage of control electrode 7 is lower than Vb. Accordingly, the feature of this embodiment resides in a configuration in which the time width tg when the voltage of control electrode 7 is lower than Vb can be selected by pulse drive circuit 92 for controlling the voltage of the control electrode 7.

Figure 12:
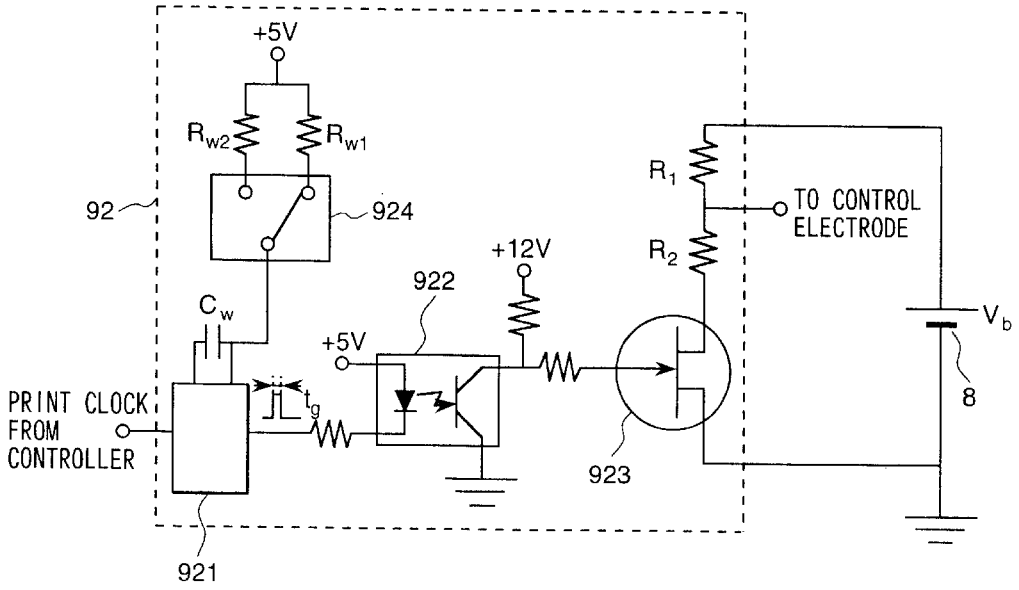
FIG. 12 is a schematic circuit diagram showing another example of the circuit structure of the pulse drive circuit for the control electrode of the present invention.

FIG. 12 shows an example of the circuit configuration of pulse drive circuit 92 in this embodiment. As described above, because the pulse width tg of the output pulse signal is determined by the product of capacitor Cw and resistor Rw provided in pulse generation circuit 921, the values Rw1 and Rw2 can be selected by selector 924 in this embodiment according to the desired resolution. For example, when Rw1 is selected as the value of the resistor, switching element 923 is driven by the pulse signal with ON-time tg1=Cw·Rw1 applied through photocoupler 922 from the pulse generation circuit 921. As a result, the voltage applied to control electrode 7 is controlled so as to become lower by Vg than electrode bias Vb just during the period of time tg1. Here, the value of the voltage Vg in the lowering direction is determined by resistors R1 and R2 connected in series with the drain of switching element 923 as mentioned above.

Although the configuration in which two resistive elements are switched has been explained as the easiest configuration, the resolution can be finely changed by providing three resistive elements or more in pulse generation circuit 921, besides the configuration mentioned above. In addition, the pulse width tg can be changed in an analogous way by changing the resistive element in the pulse generation circuit 921 to a variable resistor. According to this embodiment, the pulse voltage applied to the ink-discharge electrode 3 can be decreased by lowering the voltage applied to control electrode 7 to a voltage lower than electrode bias Vb. Further, the print dot diameter can be changed with respect to the gradation level by controlling the time to lower the voltage of the control electrode. As a result, it becomes possible to change the resolution without sacrificing the printing speed compared with the conventional method which uses pulse duration modulation.

Next, a third embodiment of the present invention will be explained. An ink jet recording apparatus in accordance with the present invention controls the ink discharge by superimposing a pulse voltage applied to the ink-discharge electrode along with a constant electrode bias. Here, the electrode bias collects the electrified coloring material particles in the ink at the point of the ink-discharge electrode in response to the electric field in the neighborhood of the ink-discharge electrode and supplies the coloring material particles to the position where ink is discharged. However, because the ink is not discharged during the print standby time, the coloring material particles stay without discharge at the point of the ink-discharge electrode in the state in which the electrode bias is applied. The coloring material particles condensate and fix at the point of the ink-discharge electrode when such a state continues. As a result, there is a fear that a defective ink discharge etc. might be caused at the following print operation. Thus, control by which the voltage is applied to recording head 1 is turned off in the print standby time in this embodiment.

Figure 14:
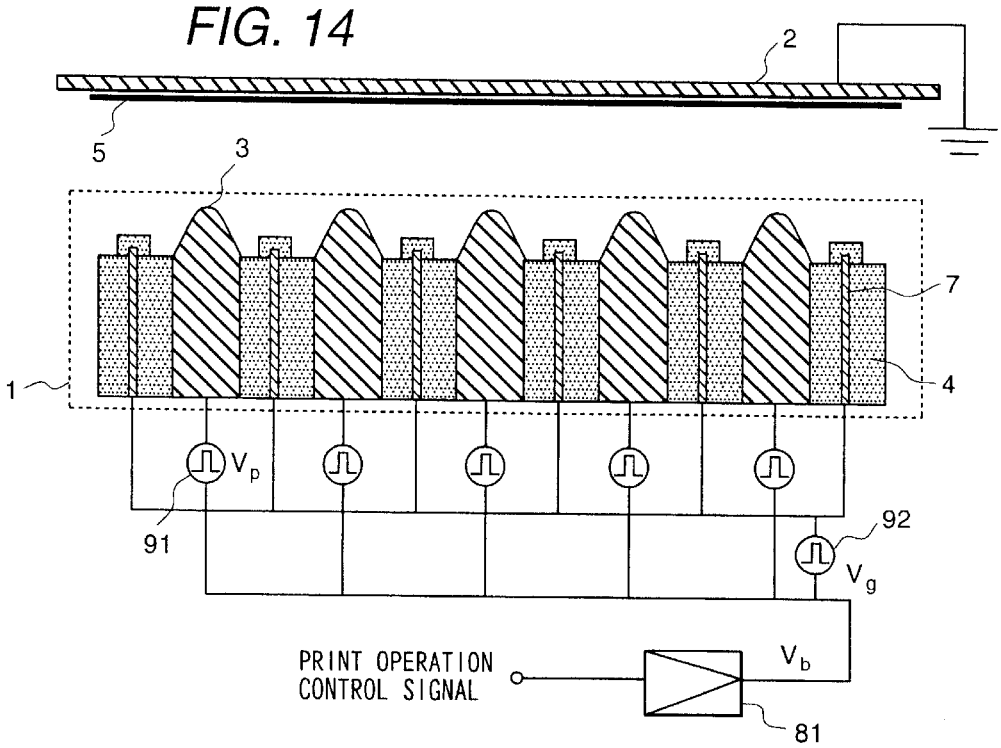
FIG. 14 is a sectional view showing another embodiment the ink jet recording apparatus according to the present invention.

FIG. 14 shows the basic configuration of an ink jet recording apparatus in this embodiment. Because recording head 1, opposed electrode 2, and recording medium 5 are the same as the above-mentioned structure, an explanation thereof is omitted here. Pulse drive circuit 91 is individually connected to ink-discharge electrode 3 in recording head 1. Further, common pulse drive circuit 92 is connected to the control electrodes 7. The concrete circuit structure of pulse drive circuits 91 and 92 can be the same as the configuration shown in FIG. 8 and FIG. 7, respectively. High voltage amplifier 81 is used instead of the bias supply in this embodiment.

Figure 15:
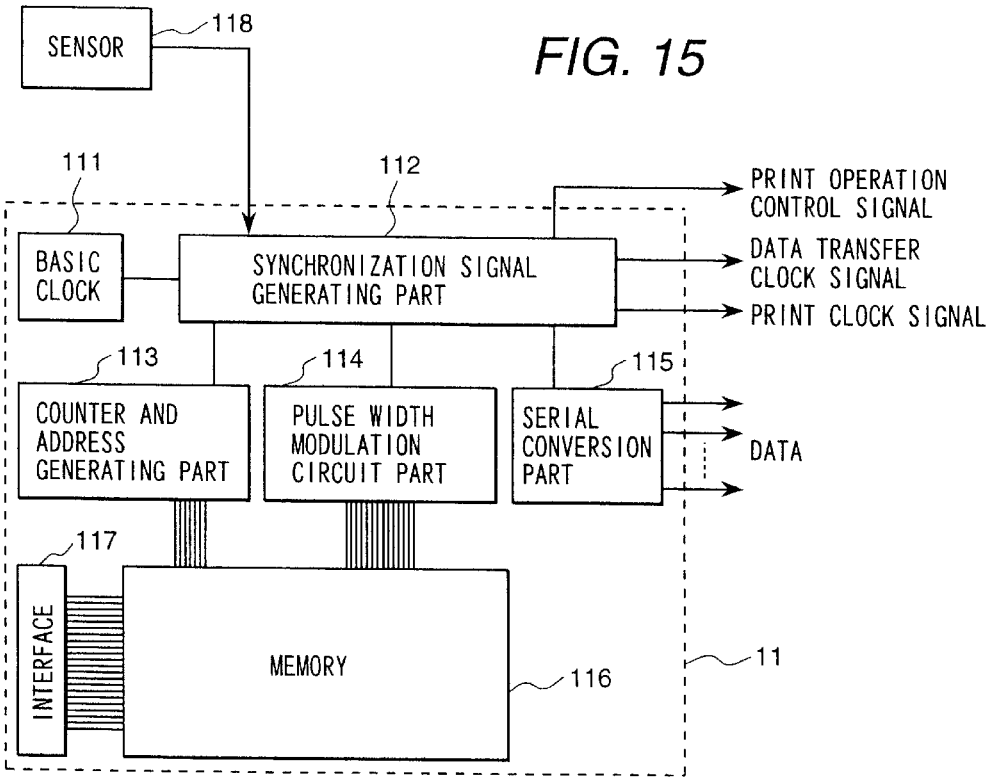
FIG. 15 is a block diagram showing another embodiment of the controller of the ink jet recording apparatus according to the present invention.

The print motion control signal is output from synchronizing signal generation circuit 112 in the controller 11 shown in FIG. 15, and this signal is input to high voltage amplifier 81. The image data sent by a personal computer, for example, is stored in memory part 116 through interface 117. When all of the image data is stored and the start command printing is originated, a signal is sent to the drive part (not shown) of the motor for transporting the recording medium 5 from synchronizing signal generation circuit 112, and the recording medium 5 is transported to a position between the recording head 1 and the opposed electrode 2, as shown in FIG. 14.

The print motion control signal becomes an ON-state and is input to high voltage amplifier 81 shown in FIG. 14, when a signal is transmitted to synchronizing signal generation part 112 by sensor 118 indicating that the recording medium 5 is at the print position. Then, the image data stored in memory 116 is read by counter and address generation unit 113 and is sent to pulse duration modulation circuit 114.

The image data is processed in pulse width modulation circuit 114 and is sorted in serial converter 115 so that the pulse voltage is output from the power output channel of the high voltage IC corresponding to the ink-discharge electrode 3 in the print position of each pixel. The output signal is transmitted to an input of the high voltage IC as serial data. Afterwards, the print data is applied from the high voltage IC to the ink-discharge electrode 3 as a pulse voltage, and the image is printed. When all of the image data is output from controller 11 and the print operation is completed, the print motion control signal becomes OFF-state in synchronizing signal generation circuit 112. Therefore, the power output of the high voltage amplifier 81 shown in FIG. 14 becomes 0V, and the voltages applied to the ink-discharge electrode 3 and control electrode 7 become 0V.

Figure 13A:
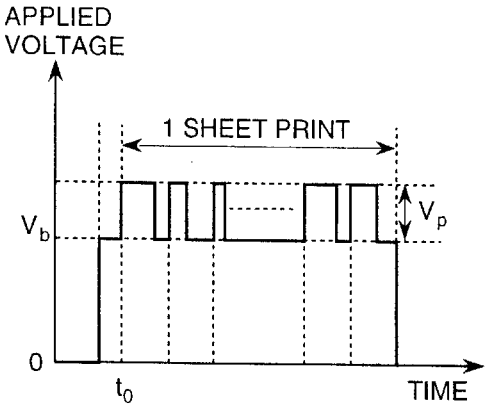
FIGS. 13(*a*) and 13(*b*) are waveform diagrams showing another example of the waveform of the voltages applied to the ink-discharge electrode and the control electrode of the present invention, respectively.
Figure 13B:
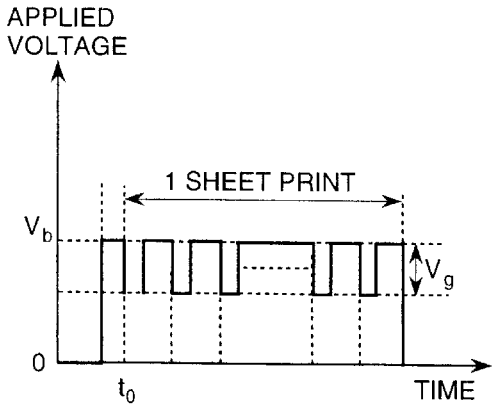

FIG. 13(*a*) shows the waveform of the voltage applied to the ink-discharge electrodes 3 and FIG. 13(*b*) shows the waveform of the voltage applied to control electrodes 7 in the above-mentioned print process. In the standby state of the print cycle, a voltage is not applied to the ink-discharge electrode 3 and control electrode 7. The print motion control signal is input to high voltage amplifier 81 when the recording medium 5 is transported and is detected by sensor 118, and the electrode bias is applied to the ink-discharge electrode 3 and control electrode 7. The print operation is started when the image data begins to be sent from controller 11. The voltage of the control electrode is controlled so that the electrode bias may be reduced in pulse level during the fixed time width tg, in synchronization with the superimposition of pulse voltage Vp on ink-discharge electrode. Because the print motion control signal is turned off after all data is printed, the voltage is not applied to the ink-discharge electrode 3 and control electrode 7 again, and the printer is placed in a standby state until the next printing operation. The electric field where the coloring material particles are concentrated is not generated at the point of the ink-discharge electrode 3 because the voltage is not applied to all electrodes in the recording head in the control of the printing operation mentioned above while not printing. As a result, the coloring material particles which remain at the point of the ink-discharge electrode 3 disappear because the coloring material particles are collected by the ink circulation.

Therefore, the cohesion of the coloring material particles can be prevented from fixing to the point of ink-discharge electrode 3 according to this embodiment. As a result, because the stability of the ink discharge from the ink-discharge electrode can be improved, the reliability for long-term use of the recording head also can be improved.

A fourth embodiment of the present invention will be explained next. The cohesion of the coloring material particles at the point of the ink-discharge electrode was prevented by adjusting the voltage applied to all of the electrodes of the recording head to 0V. To solve the above-mentioned problem, the voltage of control electrode 7 is controlled during the standby state of the printing operation in this embodiment.

Figure 16A:
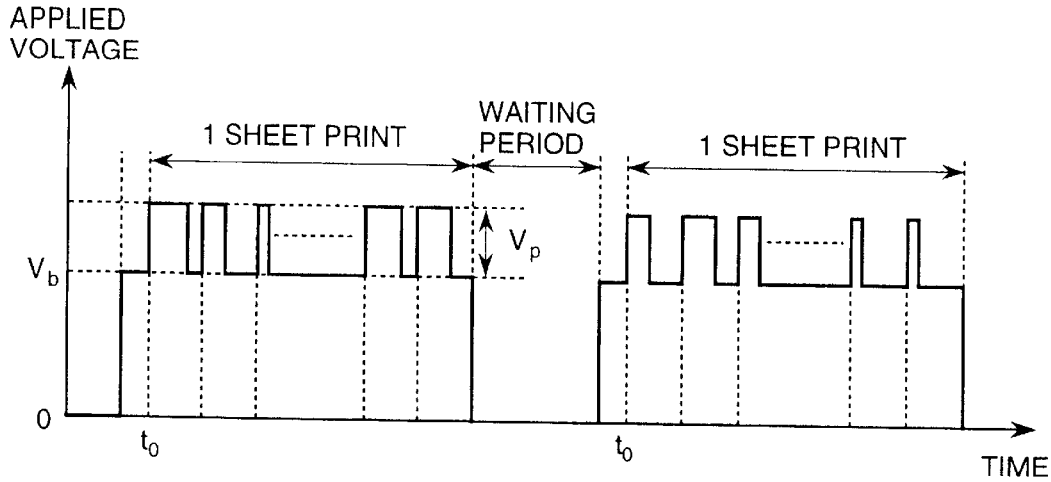
FIGS. 16A and 16B are waveform diagrams showing another example of the waveform of the voltages applied to the ink-discharge electrode and the control electrode of the present invention, respectively.
Figure 16B:
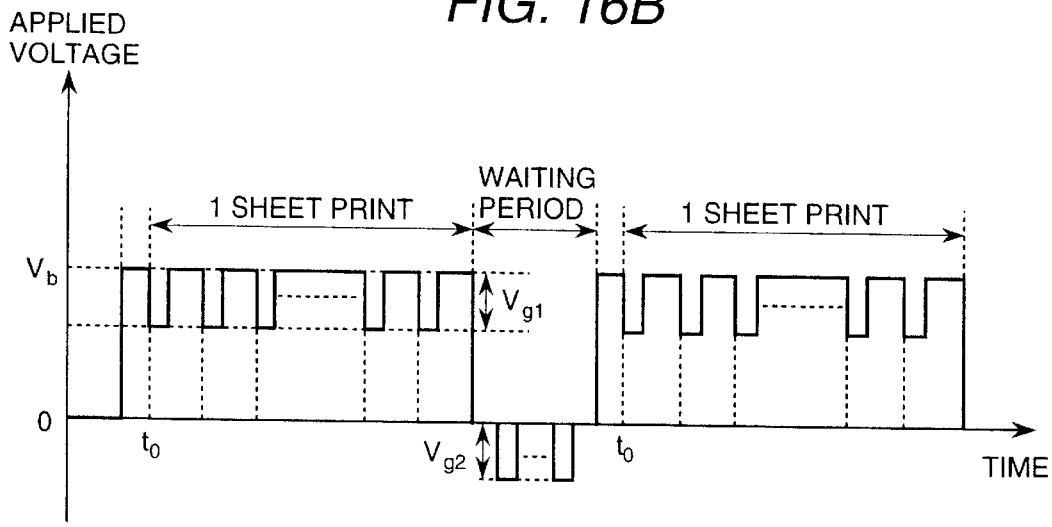

FIG. 16A shows the waveform of the voltage applied to ink-discharge electrode 3, and FIG. 16B shows the waveform of the voltage applied to control electrode 7. The electrode bias is applied to ink-discharge electrode 3 and control electrode 7 when recording medium 5 reaches the print starting position. The voltage is controlled so that the electrode bias may be reduced in pulse level by Vg1 during a fixed time width tg, in synchronization with the superimposition of the pulse voltage Vp on the ink-discharge electrode. After all of the data is printed, the voltage is not applied to the ink-discharge electrode 3 again. A lower voltage Vg2 than 0V is applied in a pulse to control electrode 7 when entering the print standby state. At this time, there is no electric field which faces the opposed electrode because ink discharge electrode 3 is kept at 0V. Besides, because a negative pulse voltage is applied to the control electrode 7, the electric field is formed in a direction from the point of ink-discharge electrode 3 to the control electrode 7. Therefore, the coloring material particles collected at the point of ink-discharge electrode 3 during the print operation are collected by the ink circulation, while being distributed in the direction of control electrode 7 by this electric field. As a result, the coloring material particles which remain at the point of the ink-discharge electrode disappears in the print standby state.

Figure 17:
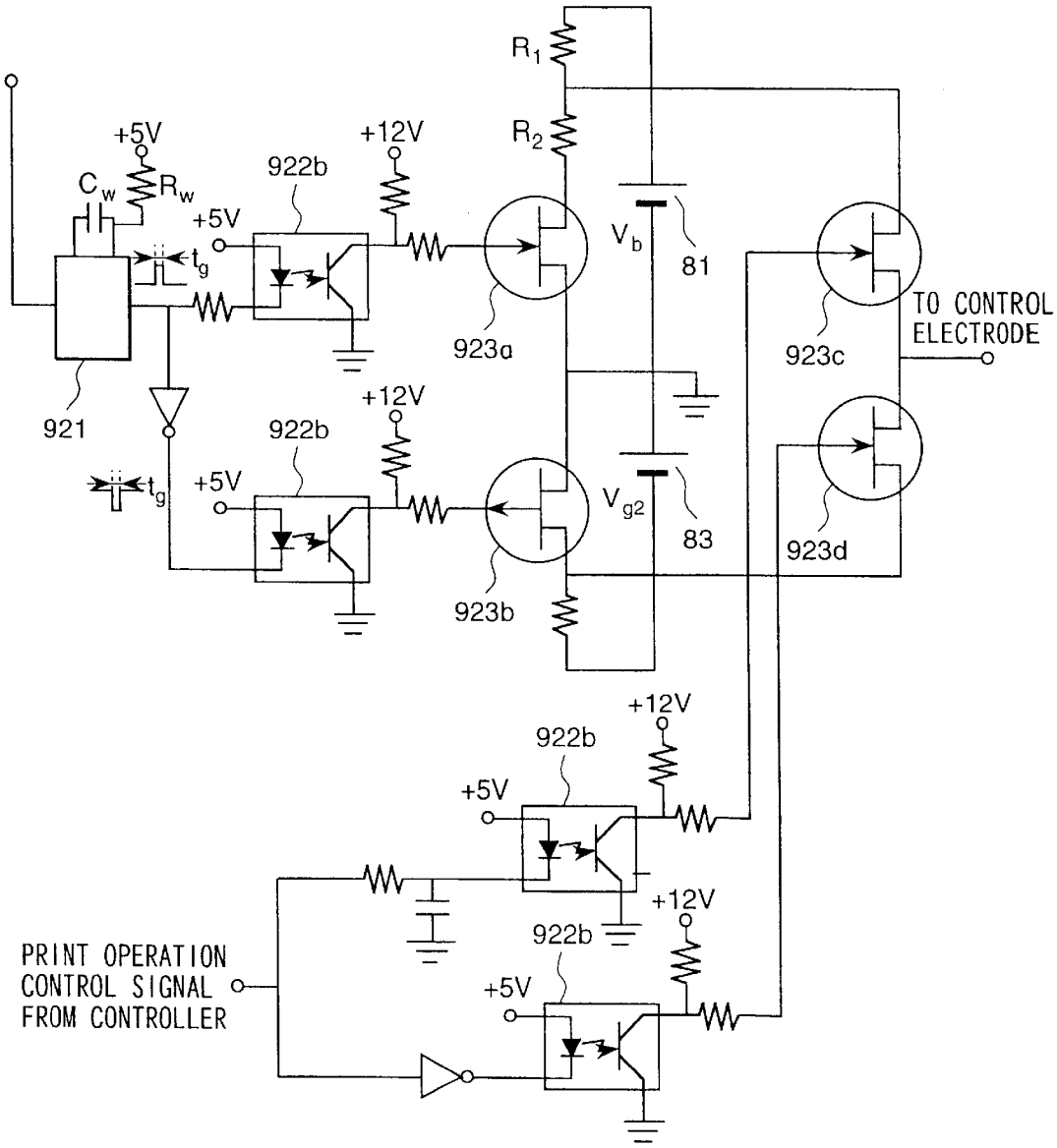
FIG. 17 is a schematic circuit diagram showing another example of the pulse drive circuit for the control electrode of.the present invention.

An example of the configuration of the pulse drive circuit 92 for controlling the voltage applied to control electrode 7 mentioned above is shown in FIG. 17. When the print clock pulse is input to pulse generation circuit 921 from the controller 11 shown in FIG. 15, a single pulse signal with the time width tg=Cw·Rw established by the product of capacitor Cw and resistor Rw is output. This pulse signal is input to photocouplers 922*a* and 922*b* in parallel. The pulse signal is input to photocoupler 922*b* in the inverted form. The power output of photocoupler 922*a* is connected to the gate input of switching element 923*a*, and switching element 923*a* operates in synchronization with the print clock pulse. Switching element 923*a* enters the state in which electrode bias Vb is applied only during the print operation, and a pulse is output which reduces the electrode bias Vb by the voltage Vg1 during time width tg, in synchronization with the print clock pulse. Lowering width Vg1 of the voltage is determined by the partial voltage of series resistors R1 and R2 connected to the drain of switching element 923*a*, as mentioned above.

On the other hand, the pulse signal input to photocoupler 922*b* is connected to the gate input of switching element 923*b*. Negative voltage Vg2 is applied to switching element 923*b*, and switching element 923*b* operates according to the pulse signal applied to the gate input. As a result, a negative pulse voltage having the lowering width Vg2 and time width tg is output to the source of switching element 923*b*. In addition, the pulse voltage power outputs of switching elements 923*a* and 923*b* are connected to switching elements 923*c* and 923*d*, respectively. The print motion control signals are input to the gate inputs of switching elements 923*c* and 923*d* in the inverted form relative to each other. Therefore, switching element 923*c* is switched to the ON-state when the print operation is performed, that is, the print motion control signal is in an ON-state, so that the pulse voltage from switching element 923*a* is output to control electrode 7, and the power output of switching element 923*b* is cut off. On the other hand, when the printer is in a standby state, switching element 923*d* is in the ON-state because the print motion control signal is in the OFF-state. The pulse voltage from switching element 923*b* is output to control electrode 7, and the power output of switching element 923*a* enters the cut-off state. Thus, the pulse voltage provided to control electrode 7 can be switched between the print operation state and the print standby state.

Therefore, when the printing operation is in the standby state in this embodiment, the cohesion of the coloring material particles can be prevented from fixed by generating an electric field where the coloring material particles have collected on the point of the ink-discharge electrode so that they are distributed. As a result, because the stability of the ink discharge from the ink-discharge electrode can be improved, the reliability to long-term use of the recording head can be improved.

Figure 18:
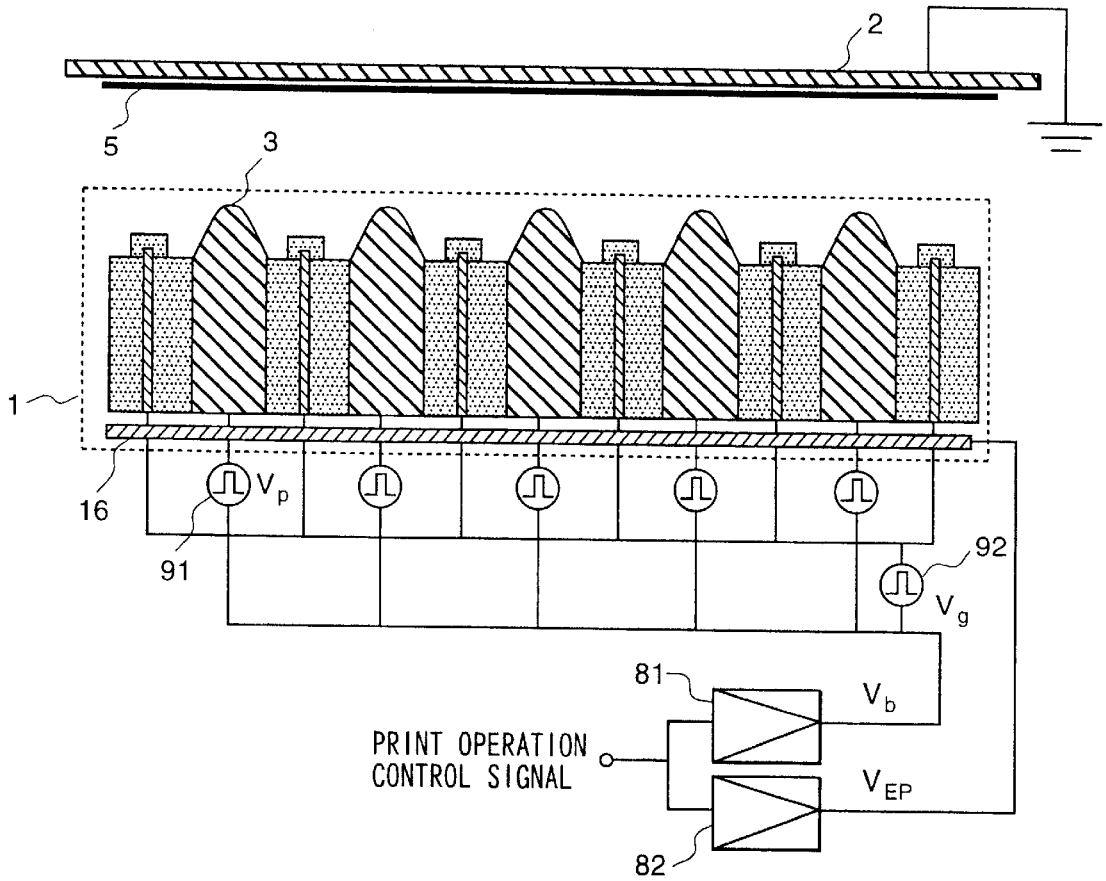
FIG. 18 is a sectional view showing another embodiment the ink jet recording apparatus according to the present invention.

Next, a fifth embodiment of the present invention will be explained. FIG. 18 shows the basic components of the ink jet recording apparatus according to this embodiment. The circuit structure of pulse drive circuits 91 and 92 is the same as the configuration shown in FIG. 8 and FIG. 7, respectively. However, bias supply 8 in FIG. 7 and FIG. 8 is replaced with high voltage amplifier 81 in this embodiment. The feature of this embodiment is that migration electrode 16 is provided in recording head 1. Migration electrode 16 is provided on the back side of recording head 1, and high voltage amplifier 82 is connected to this electrode. The print motion control signal from controller 11 shown in FIG. 15 is input in parallel to high voltage amplifiers 81 and 82.

Figure 19A:
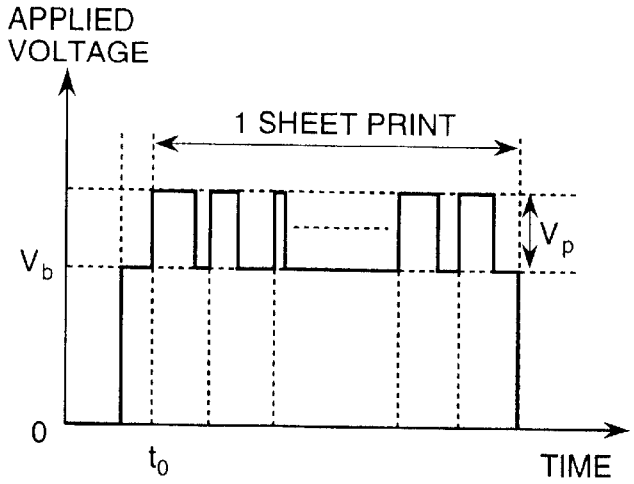
FIGS. 19A, 19B and 19C are waveform diagrams showing another example of the waveform of the voltages applied to the ink-discharge electrode and the control electrode of the present invention.
Figure 19B:
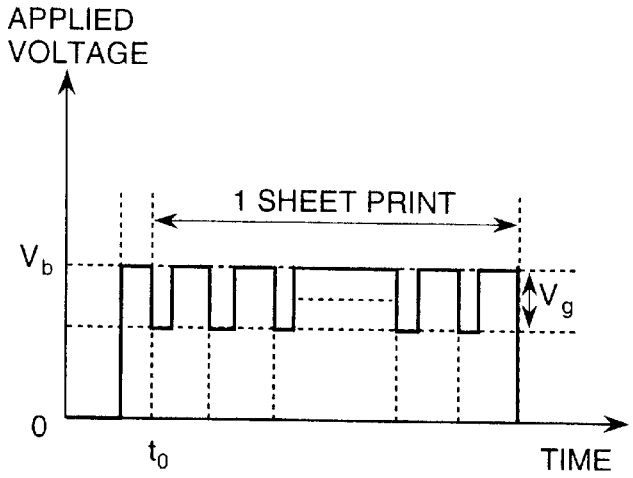
Figure 19C:
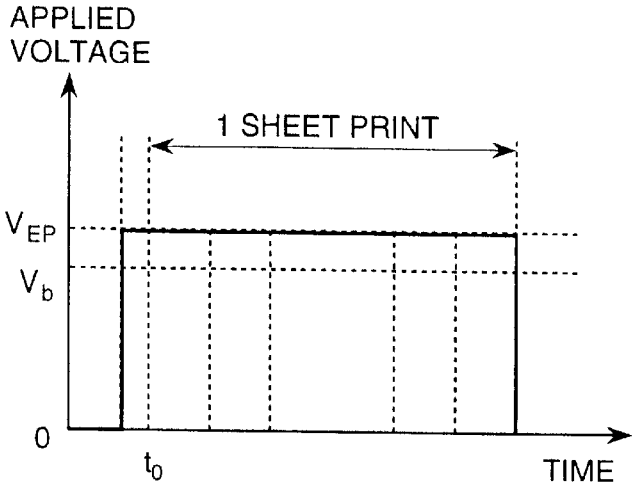

FIG. 19A shows the waveform of the voltage applied to ink-discharge electrode 3, FIG. 19B shows the waveform of the voltage applied to control electrode 7, and FIG. 19C shows the waveform of the voltage applied to migration electrode 16. In order to prevent cohesion of the coloring material particles at the point of ink-discharge electrode from becoming fixed, the voltage is not applied to ink-discharge electrode 3, control electrode 7, and migration electrode 16. When sensor 118 detects the fact that recording medium has reached the print starting position, the print motion control signal is given from synchronizing signal generation circuit 112 of the controller 11 shown in FIG. 15. Electrode bias Vb is applied in ink-discharge electrode 3 and control electrode 7 and migration voltage Vep is applied to migration electrode 16 when the print motion control signal is input to the high voltage amplifiers 81 and 82 shown in FIG. 18. Here, the amplification factor of high voltage amplifier 82 is higher than that of high voltage amplifier 82, and migration voltage Vep is higher than electrode bias Vb. Therefore, an electric field is generated where the concentration of the coloring material particles on the point of ink-discharge electrode 3 is promoted between the point of ink-discharge electrodes 3 and migration electrode 16 during the print operation. As a result, the coloring material particles can be supplied stably to the point of ink-discharge electrode 3 even when the printing speed is accelerated and the amount of consumption of the ink is increased. When the print operation is completed, both the electrode bias Vb and the migration voltage Vep become 0V because the print motion control signal is turned off.

Therefore, the coloring material particles can be supplied stably to the point of ink-discharge electrode 3 even during high-speed printing by promoting the concentration of the coloring material particles on the point of ink-discharge electrode 3 in this embodiment. As a result, a high resolution picture can be printed without decreasing the image concentration in a high-speed printing operation.

As mentioned above, an ink jet recording apparatus according to the present invention is useful for recording highly accurate pictures and characters, for example, and is particularly suitable for use in a color ink jet printer for recording on various recording media.

What is claimed is:

1. An ink jet recording apparatus comprising:

a plurality of ink-discharge electrodes;

a control electrode arranged between the adjoining ink-discharge electrodes;

an opposed electrode arranged at the opposed position in a fixed spacing from the points of a plurality of ink-discharge electrode;

a power supply connected to a plurality of said ink-discharge electrode and control electrodes;

a first pulse drive circuit connected to a plurality of said ink-discharge electrode; and a second pulse drive circuit connected to said control electrode;

wherein said the second pulse drive circuit outputs the pulse voltage with the reversed polarity to that of said first pulse drive circuit.

2. An ink jet recording apparatus according to claim 1, further comprising:

a shroud to cover said control electrode, and to form individual ink channel to a plurality of said ink-discharge electrodes.

3. An ink jet recording apparatus according to either claim 1 or 2, wherein said first pulse drive circuit outputs the voltage performed the pulse width modulation according to the record data.

4. An ink jet recording apparatus according to either claim 1 or 2, wherein said second pulse drive circuit outputs the voltage with a constant pulse width.

5. An ink jet recording apparatus according to either claim 1 or 2, wherein the power supply connected to a plurality of ink-discharge electrodes and control electrodes is a constant voltage source.

6. An ink jet recording apparatus according to claim 1 or 2, wherein said second pulse drive circuit has a means for setting the pulse width of the output voltage.

7. An ink jet recording apparatus according to claim 6, wherein the pulse width setting means of said second pulse drive circuit is a selector for switching the resistive element.

8. An ink jet recording apparatus according to claim 1 or 2, wherein the power supply connected to a plurality of ink-discharge electrodes and control electrodes is a high voltage amplifier.

9. An ink jet recording apparatus according to claim 8, wherein a signal is input to an input terminal of the said high voltage amplifier when recording.

10. An ink jet recording apparatus according to claim 8, wherein when not recording and when recording, the power output is switched by said second pulse drive circuit.

11. An ink jet recording apparatus according to claim 10, wherein the output voltage of the drive of said the second pulse drive circuit is switched by electric circuit.

12. An ink jet recording apparatus comprising:

a plurality of ink-discharge electrodes;

a control electrode arranged between the adjoining ink-discharge electrodes;

an opposed electrode arranged at the opposed position in a fixed spacing from the points of a plurality of ink-discharge electrode;

a migration electrode arranged on the opposite side of said opposed electrode with respect to said ink-discharge electrodes and said control electrodes;

a first power supply connected to a plurality of said ink-discharge electrode and control electrodes;

a second power supply connected to said migration electrode;

a first pulse drive circuit connected to a plurality of said ink-discharge electrode; and a second pulse drive circuit connected to said control electrode;

wherein said the second pulse drive circuit outputs the pulse voltage with the reversed polarity to that of said first pulse drive circuit.

13. An ink jet recording apparatus according to claim 12, further comprising:

a shroud to cover said control electrode, and to form individual ink channel to a plurality of said ink-discharge electrodes.

14. An ink jet recording apparatus according to claim 12 or 13, wherein said first power supply is connected to a plurality of said ink-discharge electrode and control electrodes, said second power supply is connected to the said migration electrode, and said first power supply and said second power supply are high voltage amplifiers.

15. An ink jet recording apparatus according to claim 14, wherein said second power supply is a high voltage amplifier whose amplification factor is higher than said first power supply.

16. An ink jet recording apparatus according to claim 15, wherein a signal is input to an input terminal of the said high voltage amplifier when recording.

17. An ink jet recording apparatus according to claim 15, wherein when not recording and when recording, the power output is switched by said second pulse drive circuit.

18. An ink jet recording apparatus according to claim 17, wherein the output voltage of the drive of said the second pulse drive circuit is switched by electric circuit.

* * * * *